US010997897B2

(12) United States Patent
Zhai et al.

(10) Patent No.: US 10,997,897 B2
(45) Date of Patent: May 4, 2021

(54) DRIVING METHOD FOR DISPLAY PANEL AND DISPLAY DEVICE

(71) Applicant: Shanghai AVIC OPTO Electronics Co., Ltd, Shanghai (CN)

(72) Inventors: Yingteng Zhai, Shanghai (CN); Tianyi Wu, Shanghai (CN)

(73) Assignee: Shanghai AVIC OPTO Electronics Co., Ltd., Shanghai (CN)

( * ) Notice: Subject to any disclaimer, the term of this patent is extended or adjusted under 35 U.S.C. 154(b) by 0 days.

(21) Appl. No.: 16/730,925

(22) Filed: Dec. 30, 2019

(65) Prior Publication Data

US 2021/0065608 A1 Mar. 4, 2021

(30) Foreign Application Priority Data

Aug. 30, 2019 (CN) ..... 201910818539.0

(51) Int. Cl.
*G09G 3/20* (2006.01)
*G09G 3/32* (2016.01)

(52) U.S. Cl.
CPC ..... *G09G 3/2022* (2013.01); *G09G 3/2074* (2013.01); *G09G 3/32* (2013.01); *G09G 2310/027* (2013.01); *G09G 2310/0286* (2013.01); *G09G 2320/0233* (2013.01); *G09G 2320/0626* (2013.01); *G09G 2360/16* (2013.01)

(58) Field of Classification Search
CPC .. G09G 3/2022; G09G 3/2029; G09G 3/2033; G09G 3/2037; G09G 3/204; G09G 3/2074; G09G 2310/027; G09G 2310/0286; G09G 2320/0233; G09G 2320/0626; G09G 2360/16
See application file for complete search history.

(56) References Cited

U.S. PATENT DOCUMENTS 6,222,512 B1 * 4/2001 Tajima ..... G09G 3/2029 345/63
6,768,479 B2 * 7/2004 Nakamura ..... G09G 3/2022 315/111.21

(Continued)

FOREIGN PATENT DOCUMENTS

CN 104751795 A 7/2015

*Primary Examiner* — Gene W Lee
(74) *Attorney, Agent, or Firm* — Christensen O'Connor Johnson Kindness PLLC

(57) ABSTRACT

A driving method for a display panel and a display device are provided. The driving method includes: dividing a one-frame period of the display panel into N sub-frames, and setting a light-emitting duration of each sub-frame, where N is a positive integer greater than 1, and i=1 to N; determining, based on a target display brightness value L, a number k of sub-frames in which a sub-pixel is to be driven to emit light, and when k<N, a light-emitting duration of any of the k sub-frames is shorter than a light-emitting duration of any other sub-frame of the N sub-frames in which the sub-pixel is not to be driven to emit light; acquiring a light-emitting brightness value $L_{emit}$ of the sub-pixel in each of the k sub-frames based on L; and driving the sub-pixel to emit light with the light-emitting brightness value $L_{emit}$ in each of the k sub-frames.

15 Claims, 9 Drawing Sheets

(56) References Cited

U.S. PATENT DOCUMENTS

| | | | | |
|---|---|---|---|---|
| 9,542,891 | B2 * | 1/2017 | Park | G09G 3/3291 |
| 10,332,453 | B2 * | 6/2019 | He | H01L 27/1214 |
| 2001/0022565 | A1 * | 9/2001 | Kimura | G09G 3/3266<br>345/82 |
| 2002/0180754 | A1 * | 12/2002 | Suzuki | G09G 3/2927<br>345/598 |
| 2003/0128199 | A1 * | 7/2003 | Kimura | G09G 3/3283<br>345/204 |
| 2007/0063934 | A1 * | 3/2007 | Ozaki | G09G 3/3258<br>345/76 |
| 2013/0169663 | A1 * | 7/2013 | Seong | G09G 5/00<br>345/589 |
| 2015/0187254 | A1 * | 7/2015 | Lee | G09G 3/3233<br>345/692 |
| 2020/0005710 | A1 * | 1/2020 | Miyata | G09G 3/3426 |

* cited by examiner

DRIVING METHOD FOR DISPLAY PANEL AND DISPLAY DEVICE

CROSS-REFERENCE TO RELATED APPLICATIONS

The present application claims priority to Chinese Patent Application No. 201910818539.0, filed on Aug. 30, 2019, the content of which is incorporated herein by reference in its entirety.

TECHNICAL FIELD

The present disclosure relates to the field of display technologies, and particularly, to a method for driving a display panel and a display device.

BACKGROUND

In the related art, sub-pixels are generally driven to emit light by means of Pulse Width Modulation (PWM). Specifically, a width of a pulse can be classified into multiple levels, and the width of the pulse is adjusted to drive the sub-pixels to emit light with different brightness, thereby realizing display at different grayscales. However, since there is a significant difference between a brightness corresponding to the highest grayscale and a brightness corresponding to the lowest grayscale, there is a significant difference between a width of the pulse corresponding to the highest grayscale and a width of the pulse corresponding to the lowest grayscale. Taking the 1st grayscale and the 255th grayscale as examples, a brightness corresponding to the 1st grayscale is 1/200,000 of a brightness corresponding to the 255th grayscale, and a width of the pulse corresponding to the 1st grayscale is 1/200,000 of a width of the pulse corresponding to the 255th grayscale accordingly. However, based on technologies in related art, it is difficult to perform a precise control on the width of the pulse with a precision of 1/200,000, which results in display with a low precision at a low grayscale.

SUMMARY

In a first aspect, an embodiment of the present disclosure provides a method for driving a display panel, comprising: dividing a one-frame period of the display panel into N sub-frames, and setting a light-emitting duration $T_i$ of an $i^{th}$ sub-frame of the N sub-frames, wherein N is a positive integer greater than 1, and i=1 to N; determining, based on a target display brightness value L, a number k of sub-frames of the N sub-frames in which a sub-pixel is to be driven to emit light, wherein when k<N, a light-emitting duration of any one of the k sub-frames is shorter than a light-emitting duration of any other one of the N sub-frames in which the sub-pixel is not to be driven to emit light; acquiring a light-emitting brightness value $L_{emit}$ of the sub-pixel in each of the k sub-frames based on the target display brightness value L; and driving the sub-pixel to emit light with the light-emitting brightness value $L_{emit}$ in each of the k sub-frames.

In another aspect, an embodiment of the present disclosure provides a display device, comprising: a display panel comprising a plurality of scanning lines, a plurality of data lines, and a plurality of sub-pixels, wherein the plurality of scanning lines intersect with the plurality of data lines to define the plurality of sub-pixels; a data driving module configured to provide a data voltage to the plurality of data lines; a scan driving module configured to sequentially provide a scanning signal to the plurality of scanning lines; a light-emitting duration setting module configured to divide a one-frame period of the display panel into N sub-frames and to set a light-emitting duration $T_i$ of an $i^{th}$ sub-frame of the N sub-frames, wherein N is a positive integer greater than 1, and i=1 to N; a light-emitting sub-frame number setting module electrically connected to the light-emitting duration setting module, and configured to determine, based on a target display brightness value L, a number k of sub-frames of the N sub-frames in which a sub-pixel of the plurality of sub-pixels is to be driven to emit light, wherein when k<N, a light-emitting duration of any one of the k sub-frames is shorter than a light-emitting duration of any other one of the N sub-frames in which the sub-pixel is not to be driven to emit light; a light-emitting brightness setting module electrically connected to both the light-emitting duration setting module and the light-emitting sub-frame number setting module and configured to acquire a light-emitting brightness value $L_{emit}$ of the sub-pixel in each of the k sub-frames based on the target display brightness value L; and a driving module electrically connected to the data driving module, the scan driving module, the light-emitting sub-frame number setting module and the light-emitting brightness setting module, and configured to drive the data driving module to provide the plurality of data lines with a light-emitting data voltage signal corresponding to the light-emitting brightness value $L_{emit}$ and to drive the scan driving module to provide the scanning signal to the plurality of scanning lines in each of the k sub-frames, so as to control the sub-pixel to emit light.

BRIEF DESCRIPTION OF DRAWINGS

In order to illustrate technical solutions of embodiments of the present disclosure, the accompanying drawings used in the embodiments are introduced hereinafter. These drawings merely illustrate some embodiments of the present disclosure. On the basis of these drawings, those skilled in the art can also obtain other drawings.

DESCRIPTION OF EMBODIMENTS

In order to better understand technical solutions of the present disclosure, the embodiments of the present disclosure are described in detail with reference to the drawings.

It should be clear that the described embodiments are merely part of the embodiments of the present disclosure rather than all of the embodiments. Based on the embodiments in the present disclosure, all other embodiments obtained by those skilled in the art shall fall into the protection scope of the present disclosure.

The terms used in the embodiments of the present disclosure are merely for the purpose of describing particular embodiments and not intended to limit the present disclosure. Unless otherwise noted in the context, the singular form expressions "a", "an", "the" and "said" used in the embodiments and appended claims of the present disclosure are also intended to represent a plural form.

It should be understood that the term "and/or" used in the context of the present disclosure is to describe a correlation relation of related objects, indicating that there may be three relations, e.g., A and/or B may indicate only A, both A and B, and only B. In addition, the symbol "/" in the context generally indicates that the relation between the objects in front and at the back of "/" is an "or" relationship.

Figure 1:
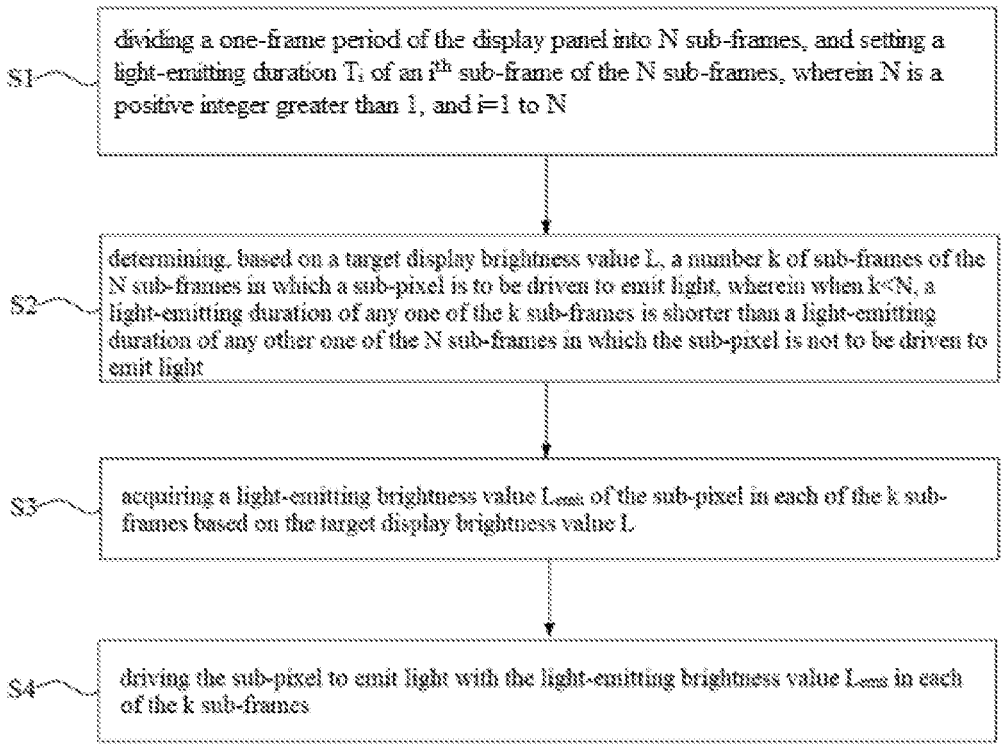
FIG. 1 is a flowchart of a driving method according to an embodiment of the present disclosure.

An embodiment of the present disclosure provides a driving method for a display panel. FIG. 1 is a flowchart of a driving method according to an embodiment of the present disclosure. As shown in FIG. 1, the driving method includes steps S1 to S4.

In step S1, a one-frame period of the display panel is divided into N sub-frames, and a light-emitting duration $T_i$ of an $i^{th}$ sub-frame of the N sub-frames is set, where N is a positive integer greater than 1, and i=1 to N.

Taking a display panel including n rows of sub-pixels as an example, in a one-frame period of the display panel, it is required to sequentially scan the n rows of sub-pixels N times, that is, in each sub-frame, the n rows of sub-pixels are sequentially scanned once, respectively.

In step S2, a number k of sub-frames of the N sub-frames in which the sub-pixels are to be driven to emit light is determined based on a target display brightness value L. When k<N, a light-emitting duration of any one of the k sub-frames is shorter than a light-emitting duration of any other sub-frame of the N sub-frames in which the sub-pixels are not to be driven to emit light.

In step S3, a light-emitting brightness value $L_{emit}$ of the sub-pixels in each of the k sub-frames is acquired based on the target display brightness value L.

In step S4, the sub-pixels are driven to emit light with the light-emitting brightness value $L_{emit}$ in each of the k sub-frames.

It should be understood that the display panel includes sub-pixels of multiple colors. When the display panel display images within a one-frame period, the sub-pixels of different colors are driven to emit light with different brightness, so that the sub-pixels of different colors present different display brightness in the one-frame period to form a plurality of color points that constitute a complete image to be displayed by the display panel in the one-frame period.

Utilizing the driving method of the embodiment of the present disclosure, for one sub-pixel, the number k of sub-frames, in which the sub-pixel is to be driven to emit light, and a light-emitting brightness value $L_{emit}$ of the sub-pixel in the k sub-frames are acquired according to the target display brightness value L of the sub-pixel to be displayed in a one-frame period. Since both the number k of light-emitting sub-frames and the light-emitting brightness value $L_{emit}$ are determined by the target display brightness value L of the sub-pixel, the number k of the light-emitting sub-frames and the light-emitting brightness value $L_{emit}$ can be accurately adjusted according to a change of the target display brightness value L. That is, by setting k and $L_{emit}$ each at a relatively small value, the sub-pixel emits light of relatively low brightness in fewer sub-frames, and thus display at a low grayscale can be presented accurately. Moreover, when k<N, it is set that the light-emitting duration of any one of the k sub-frames is shorter than the light-emitting duration of any other sub-frame of the N sub-frames in which the sub-pixel is not to be driven to emit light, so that the sub-pixel emits light within the sub-frame having a shorter light-emitting duration. While displaying at a low grayscale, a display precision of the sub-pixel can be further improved by using the light-emitting sub-frame having a shorter light-emitting duration, thereby further improving the display precision at the low grayscale.

It can be understood that, since each sub-pixel only needs to correspond to one target display brightness value in a one-frame period, the light-emitting brightness value $L_{emit}$ corresponding to the same sub-pixel in the k light-emitting sub-frames is constant in the same one-frame period. However, light-emitting brightness values $L_{emit}$ corresponding to the same sub-pixel may be different in different one-frame periods, and light-emitting brightness values $L_{emit}$ corresponding to different sub-pixels may also be different in the same one-frame period.

In an embodiment, when setting the light-emitting duration of each of the N sub-frames, it is set that $T_i > T_{i-1}$, where $T_i$ is a light-emitting duration of an $i^{th}$ sub-frame of the N sub-frames, and $T_{i-1}$ is a light-emitting duration of a $(i-1)^{th}$ sub-frame of the N sub-frames. A person of ordinary skill would understand that the notation i, i−1, $i^{th}$, N, etc., is a sample non-limiting notation. Alternative notations of the indices can also be used, for example, m, m−1, $m^{th}$, etc. In the context of this disclosure, these (and other analogous) notations are used alternatively. In different embodiments, m (or i, or other analogous notation) ranges from m=2 to m=N. In some embodiments, the light-emitting durations of the N sub-frames gradually increase. In this way, when the duration of the one-frame period is constant, since the light-emitting durations of the N sub-frames gradually increase, it can be ensured that there are a certain number of sub-frames each having a relatively short light-emitting duration in the N sub-frames, such that, when displaying at a low grayscale, the display precision at the low gray-scale can be further improved by controlling the sub-pixel to emit light in the sub-frames each having a relatively short light-emitting duration.

Figure 2:
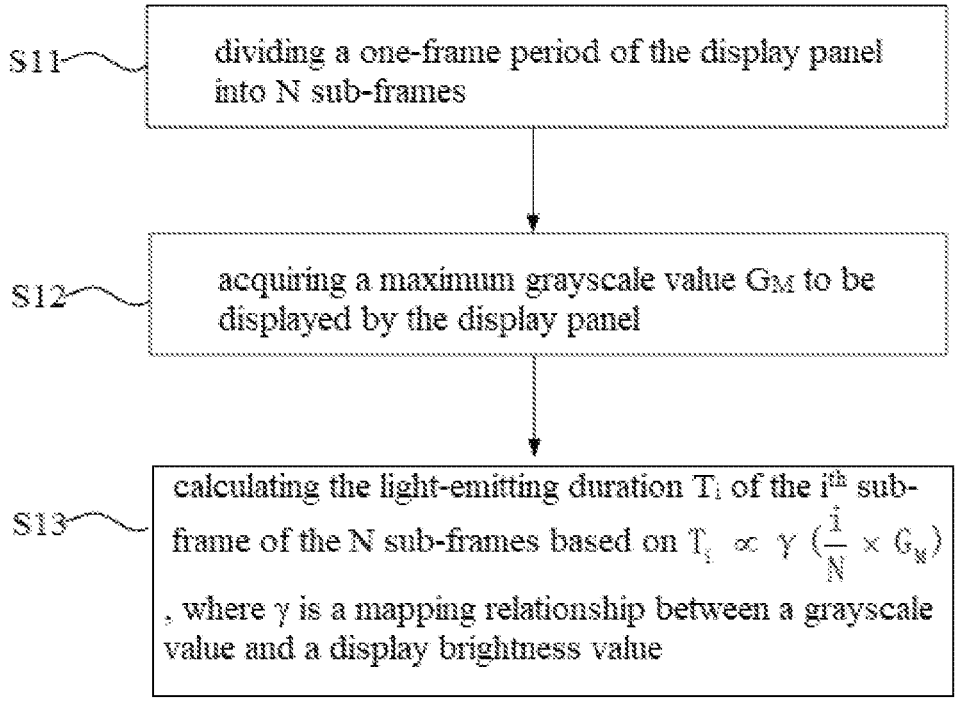
FIG. 2 is another flow chart of a driving method according to an embodiment of the present disclosure.

FIG. 2 is another flowchart of a driving method according to an embodiment of the present disclosure. In this embodiment, as shown in FIG. 2, step S1 can include steps S11 to S13.

In step S11, a one-frame period of the display panel is divided into N sub-frames.

In step S12, a maximum grayscale value $G_M$ to be displayed by the display panel is acquired. The maximum grayscale value $G_M$ refers to a maximum grayscale value to be displayed by the sub-pixels in the display panel, based on a grayscale setting range of the display panel. For example, if the grayscale setting range of the display panel is from 0 to 255, the maximum grayscale value $G_M$ is 255.

In step S13, the light-emitting duration $T_i$ of the $i^{th}$ sub-frame of the N sub-frames is calculated based on $$T_i \propto \gamma\left(\frac{i}{N} \times G_M\right),$$

where γ is a mapping relationship between a grayscale value and a display brightness value.

When the display panel displays images in a one-frame period, there may be some sub-pixels that need to display with a display brightness value corresponding to the maximum grayscale value $G_M$. Therefore, by calculating the light-emitting duration of each sub-frame according to the maximum grayscale value $G_M$, it can be ensured that the sub-pixel can display with a display brightness corresponding to the maximum grayscale value when the sub-pixel emits light in the sub-frame, which improves the display precision of the sub-pixel.

Figure 3:
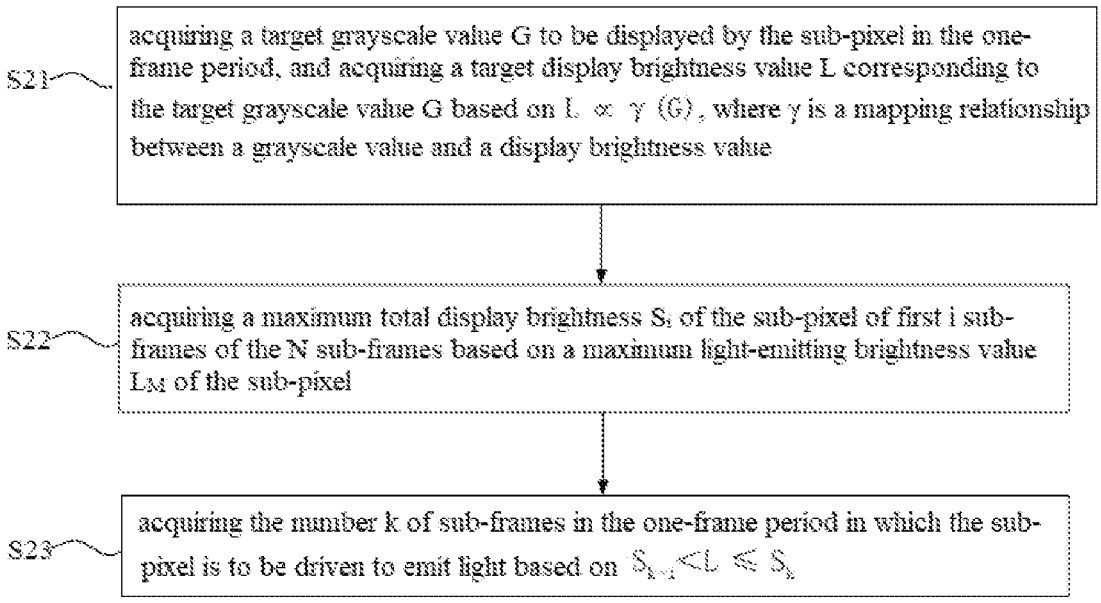
FIG. 3 is yet another flowchart of a driving method according to an embodiment of the present disclosure.

FIG. 3 is yet another flowchart of the driving method according to an embodiment of the present disclosure. In this embodiment, as shown in FIG. 3, step S2 can include steps S21 to S23.

In step S21, a target grayscale value G to be displayed by the sub-pixel in the one-frame period is acquired, and a target display brightness value L corresponding to the target grayscale value G is acquired based on $L \propto \gamma(G)$, where γ is a mapping relationship between a grayscale value and a display brightness value. It should be noted that a driving chip determines a target grayscale value G corresponding to each sub-pixel according to an image to be displayed by the display panel in a one-frame period, and further acquires a corresponding target display brightness value L.

In step S22, a maximum total display brightness $S_1$ of the sub-pixel of first i sub-frames of the N sub-frames is acquired based on a maximum light-emitting brightness value $L_M$ of the sub-pixel. The maximum light-emitting brightness value $L_M$ of the sub-pixel refers to a brightness value achieved by the sub-pixel when the sub-pixel continuously displays for a time period of one frame under a maximum driving current.

In step S23, the number k of sub-frames in the one-frame period in which the sub-pixel is to be driven to emit light is acquired based on $S_{k-1} < L \leq S_k$.

Theoretically, if the target display brightness value L is constant, when setting k and $L_{emit}$, a larger k value may be adopted, and the Luau value can be reduced accordingly. In the embodiment of the present disclosure, the k value is obtained by comparing the target display brightness value L and the maximum total display brightness $S_{k-1}$ and $S_k$, such that a k value that is as small as possible can be acquired on a premise that it is ensured that the sub-pixel can reach the target display brightness value L in the one-frame period, that is, to cause the sub-pixel to emit light in a sub-frame having a shorter light-emitting duration, thereby further improving the display precision when displaying at a low grayscale.

Figure 4:
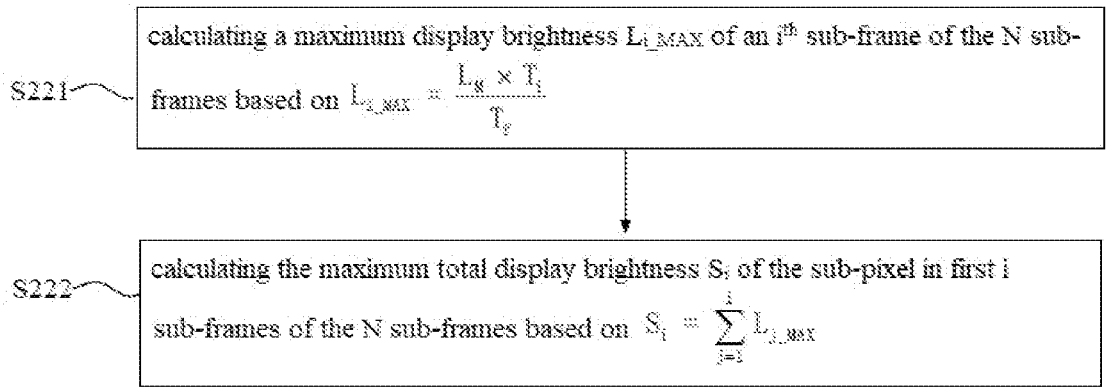
FIG. 4 is still yet another flowchart of a driving method according to an embodiment of the present disclosure.

FIG. 4 is still another flowchart of a driving method according to an embodiment of the present disclosure. In this embodiment, as shown in FIG. 4, Step S22 can include steps S221 and S222.

In step S221, a maximum display brightness $L_{i_MAX}$ of an $i^{th}$ sub-frame of the N sub-frames is calculated based on $$L_{i_MAX} = \frac{L_M \times T_i}{T_f}.$$

In step S222, the maximum total display brightness $S_i$ of the sub-pixel in first i sub-frames of the N sub-frames is calculated based on $$S_i = \sum_{j=1}^{i} L_{j_MAX},$$

i.e., $S_i = L_{1_MAX} + L_{2_MAX} + \ldots + L_{i_MAX}$.

Since the light-emitting durations of different sub-frames are different, firstly, the maximum display brightness of each sub-frame is calculated according to the maximum light-emitting brightness value $L_M$ of the sub-pixel and a light-emitting duration of each sub-frame, and then the maximum total display brightness $S_i$ of the first i sub-frames is accurately calculated according to a maximum display brightness corresponding to each of the first i sub-frames, and then k is accurately acquired.

In an embodiment, the step S3 can include acquiring the light-emitting brightness value $L_{emit}$ based on $$L_{emit} = \frac{L \times T_f}{T_1 + T_2 + \ldots + T_k},$$

where $T_f$ is a duration of the one-frame period.

After determining the number k of sub-frames in which the sub-pixel is to be driven, when the sub-pixel emits light with the light-emitting brightness value $L_{emit}$, the total display brightness in the k sub-frames should be a target display brightness corresponding to the sub-pixel, i.e., $$L = \frac{\sum_{i=1}^{k} L_{emit} T_i}{T_f},$$

and then it follows:

$$L_{emit} = \frac{L \times T_f}{T_1 + T_2 + \ldots + T_k}.$$

It can be seen that, according to the formula, the light-emitting brightness value Luau is acquired, and when the sub-pixel is controlled to emit light with the light-emitting brightness value Luau in the k sub-frames, it can be ensured that the display brightness of the sub-pixel in the one-frame period is the target display brightness, thereby ensuring the display precision.

Figure 5:
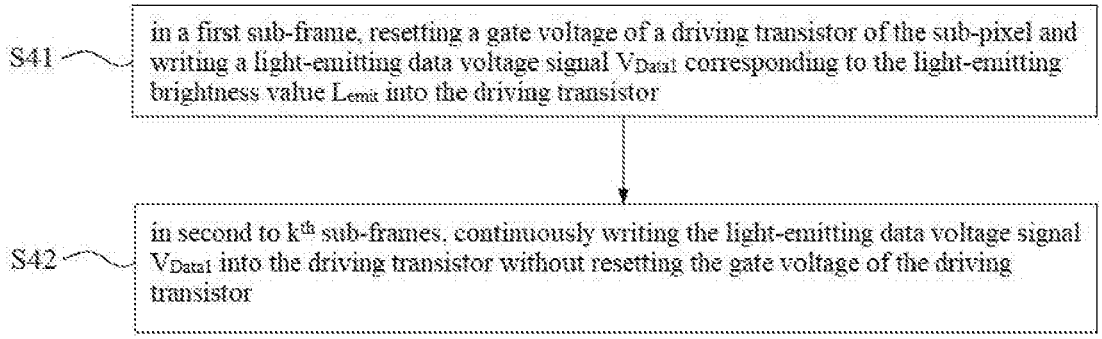
FIG. 5 is another flowchart of a driving method according to an embodiment of the present disclosure.

FIG. 5 is another flowchart of a driving method according to an embodiment of the present disclosure. In this embodiment, as shown in FIG. 5, the step S4 can include steps S41 and S42.

In step S41, in a first sub-frame, a gate voltage of a driving transistor of the sub-pixel is reset and a light-emitting data voltage signal $V_{Data1}$ corresponding to the light-emitting brightness value $L_{emit}$ is written into the driving transistor.

In step S42, in second to $k^{th}$ sub-frames, the gate voltage of the driving transistor is not reset and the light-emitting data voltage signal $V_{Data1}$ is continuously written into the driving transistor.

Figure 6:
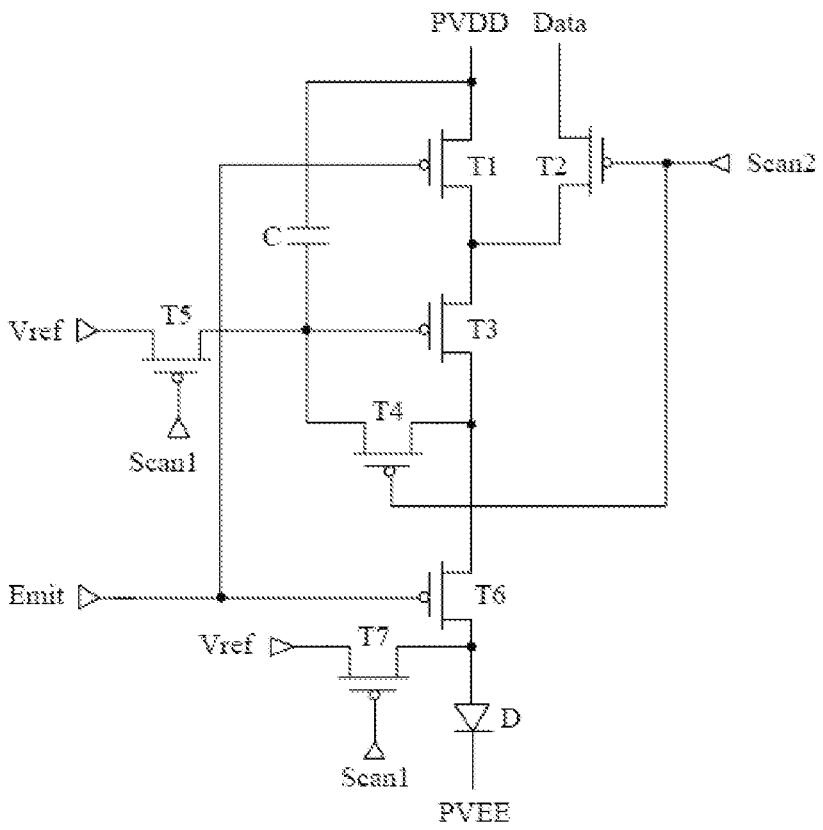
FIG. 6 (Prior art)
FIG. 6 is a structural schematic diagram of a pixel circuit in the related art.
Figure 7:
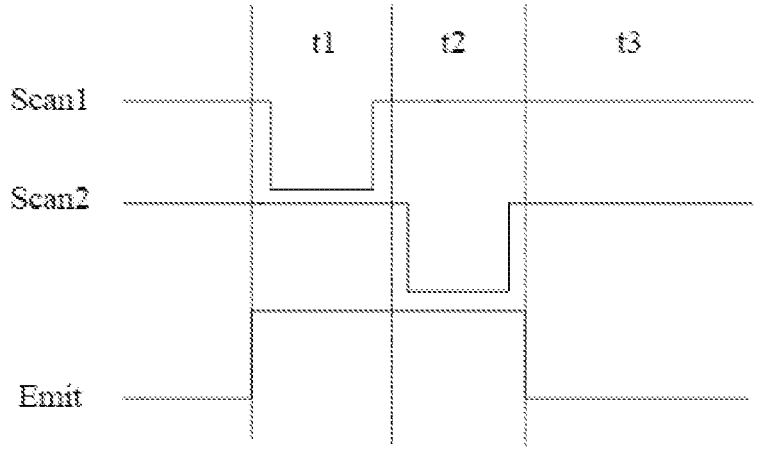
FIG. 7 is a signal timing diagram corresponding to FIG. 6.

In order to clarify the technical solution of the present disclosure, taking a pixel circuit of the sub-pixel adopting a structure shown in FIG. 6 as an example, firstly, a working principle of the pixel circuit in the related art is described. As shown in FIG. 6 and FIG. 7, FIG. 6 is a structural schematic diagram of a pixel circuit in the related art, and FIG. 7 is a signal timing diagram corresponding to FIG. 6. One driving cycle of the pixel circuit includes an initialization period t1, a charging period t2, and a light-emitting control period t3.

In the initialization period t1, a first scanning signal Scan1 of a low level is provided, a fifth transistor T5 and a seventh transistor T7 are turned on under a control of the first scanning signal Scan1, and a gate voltage of a driving transistor T3 and an anode of a light-emitting diode D are reset using a reference voltage signal Vref.

During the charging period t2, a second scanning signal Scan2 of a low level is provided, a second transistor T2 and a fourth transistor T4 are turned on under a control of the second scanning signal Scan2, a third transistor T3 is turned on under a control of the reference voltage signal Vref, and a data line Data writes a data voltage signal $V_{Data}$ to the driving transistor T3.

During the light-emitting control period t3, a light-emitting control signal Emit of a low-level is provided, a first transistor T1 and a sixth transistor T6 are turned on under a control of the light-emitting control signal Emit, to drive the light-emitting diode D to emit light under control of the written data voltage signal $V_{Data}$ and a power supply signal $V_{PVDD}$ provided by a power supply signal line PVDD. Herein, $$I = \frac{1}{2}\mu_n C_{ox}\frac{W}{L}(V_{PVDD} - V_{Data})^2,$$

where I represents a driving current flowing into the light-emitting diode D, $\mu_n$ represents an electron mobility, $C_{ox}$ represents a capacitance of a gate oxide layer per unit area, W/L represents a width-to-length ratio of a channel, $V_{gs}$ represents a gate-source voltage of the driving transistor T3, and $V_{th}$ represents a threshold voltage of the driving transistor T3.

Figure 8:
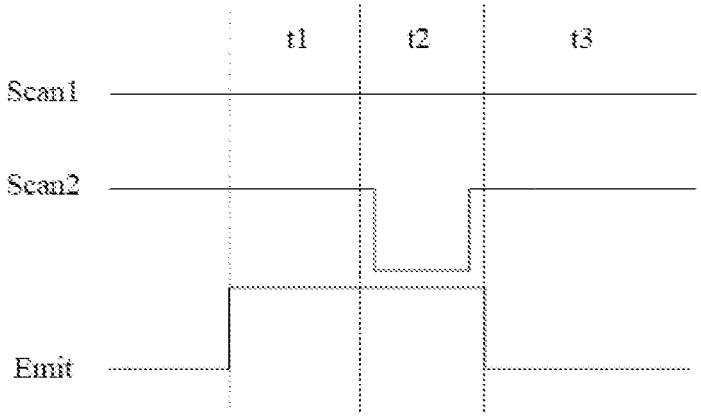
FIG. 8 is another signal timing diagram according to an embodiment of the present disclosure.

Based on the working principle of the pixel circuit in the embodiment of the present disclosure, for one sub-pixel, in the first sub-frame, in the initialization period, the first scanning signal of the low level is provided and the gate voltage of the driving transistor is reset using the first scanning signal. In the data writing period, the second scanning signal of the low level is provided, and the light-emitting data voltage signal $V_{Data1}$ corresponding to the light-emitting brightness value $L_{emit}$ is written into the driving transistor, and the light-emitting data voltage signal $V_{Data1}$ corresponding to the light-emitting luminance value $L_{emit}$ is written into the driving transistor to drive the sub-pixel to emit light. At this time, the timing diagram of the first scanning signal is as shown in FIG. 7. In the $2^{nd}$ to $k^{th}$ sub-frames, since the light-emitting brightness value of the sub-pixel is not changed, in the $2^{nd}$ to $k^{th}$ sub-frames, in the initialization period, it is not necessary to provide the first scanning signal of the low level, and the gate voltage of the driving transistor is not reset, such that the gate voltage of the driving transistor is continuously maintained as the reference voltage signal, the driving transistor is continuously turned on, and the light-emitting data voltage signal $V_{Data1}$ is continuously written into the driving transistor during the data writing period, such that the sub-pixel maintains a light-emitting brightness value $L_{emit}$. At this time, the timing diagram of the first scanning signal is as shown in FIG. 8. With such driving method, the data voltage signal does not need to be rewritten in the $2^{nd}$ to $k^{th}$ sub-frames, which not only reduces a complexity of the driving method and simplifies a driving process, but also saves writing time of the data voltage signal in the $2^{nd}$ to $k^{th}$ sub-frames.

In an embodiment, when k<N, the driving method can further include: in (k+1)th to $N^{th}$ sub-frames, not resetting the gate voltage of the driving transistor, and writing a black state data voltage signal $V_{Data2}$ into the driving transistor, where the black state data voltage signal $V_{Data2}$ refers to a data voltage signal configured to drive the sub-pixel not to emit light but to present a black state image. In combination with the formula of the driving current $$I = \frac{1}{2}\mu_n C_{ox}\frac{W}{L}(V_{PVDD} - V_{Data})^2$$

in the working principle of the pixel circuit, the black state data voltage signal $V_{Data2}$ can be equal to $V_{PVDD}$. At this time, the driving current flowing into the light-emitting diode D is 0, the sub-pixel does not emit light, and the black state picture is presented.

In the $(k+1)^{th}$ to $N^{th}$ sub-frames, by writing the black data voltage signal $V_{Data2}$ into the driving transistor, the sub-pixel can be prevented from emitting light, thereby avoiding affecting an actual display brightness value of the sub-pixel in the one-frame period and avoiding deviation from the target brightness value. Since it is only required that the sub-pixel present a black state in the $(k+1)^{th}$ to $N^{th}$ sub-frames, in order to further simplify the driving method and save the writing time of the data voltage signal, attention is directed to FIG. 8 again, where, during the initialization period, the first scanning signal of the low level is not provided, the gate voltage of the driving transistor is not reset, and it is only required that the black state data voltage signal $V_{Data2}$ be directly written into the driving transistor.

Figure 9:
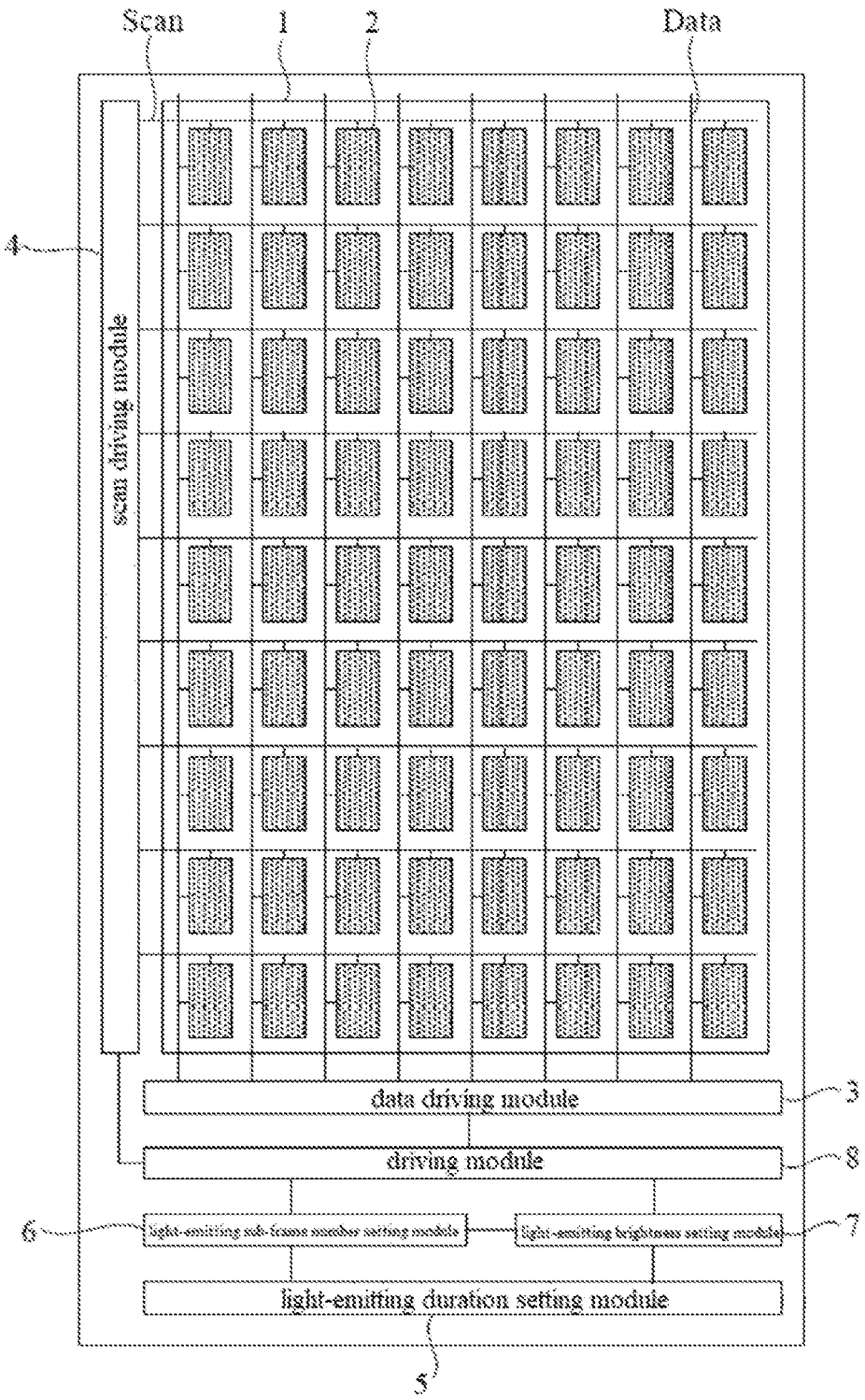
FIG. 9 is a structural schematic diagram of a display device according to an embodiment of the present disclosure.

The present disclosure further provides a display device. FIG. 9 is a structural schematic diagram of a display device according to an embodiment of the present disclosure. As shown in FIG. 9, the display device includes a display panel 1, including a plurality of scanning lines Scan, a plurality of data lines Data, and a plurality of sub-pixels 2. The plurality of scanning lines Scan intersects with the plurality of data lines Data to define the plurality of sub-pixels 2. The display device further includes a data driving module 3, a scan driving module 4, a light-emitting duration setting module 5, a light-emitting sub-frame number setting module 6, a light-emitting brightness setting module 7, and a driving module 8. The data driving module 3 is configured to provide a data voltage to the data lines Data, and the scan driving module 4 is configured to sequentially provide a scanning signal to the scanning lines Scan. The light-emitting duration setting module 5 is configured to divide a one-frame period of the display panel into N sub-frames and to set a light-emitting duration $T_i$ of an $i^{th}$ sub-frame of the N sub-frames, where N is a positive integer greater than 1, and i=1 to N. The light-emitting sub-frame number setting module 6 is electrically connected to the light-emitting duration setting module 5, and is configured to determine the number k of sub-frames in which the sub-pixel 2 is to be driven to emit light based on a target display brightness value L. When k<N, a light-emitting duration of any one of the k sub-frames is shorter than a light-emitting duration of any other sub-frame of the N sub-frames in which the sub-pixel 2 is not to be driven to emit light. The light-emitting brightness setting module 7 is electrically connected to both the light-emitting duration setting module 5 and the light-emitting sub-frame number setting module 6, and is configured to acquire a light-emitting brightness value $L_{emit}$ of the sub-pixel 2 in each of the k sub-frames based on the target display brightness value L. The driving module 8 is electrically connected to the data driving module 3, the scan driving module 4, the light-emitting sub-frame number setting module 6, and the light-emitting brightness setting module 7. The driving module 8 is configured to drive the data driving module 3 to provide a light-emitting data voltage signal corresponding to the light-emitting brightness value $L_{emit}$ to the data lines Data, and to drive the scan driving module 4 to provide the scanning signal to the scanning lines Scan in each of the k sub-frames to control the sub-pixel 2 to emit light.

According to the display device provided by the embodiment of the present disclosure, the light-emitting sub-frame number setting module 6 and the light-emitting brightness setting module 7 can acquire, according to the target display brightness value L to be displayed by the sub-pixel 2 in the one-frame period, the number k of sub-frames in which the sub-pixel 2 is to be driven to emit light and the corresponding light-emitting brightness value $L_{emit}$ of the sub-pixel 2 in the k sub-frames, respectively. Further, the driving module 8 is utilized to drive the data driving module 3 and the scan driving module 4, such that the sub-pixel 2 emits light with a brightness value Lula in the k sub-frames, thereby causing the sub-pixel 2 to display with the target display brightness value L in the one-frame period. Since both the number k of the light-emitting sub-frames and the light-emitting brightness value $L_{emit}$ are determined according to the target display brightness value L of the sub-pixel 2, the number k of the light-emitting sub-frames and the light-emitting brightness value $L_{emit}$ can be accurately adjusted according to the change of the target display brightness value L. That is, by setting k and $L_{emit}$ each at a small value, i.e., setting that the sub-pixel 2 emits light of lower brightness in fewer sub-frames, display at the low grayscale can be presented accurately. Moreover, when k<N, by setting that the light-emitting duration of any one of the k sub-frames is shorter than the light-emitting duration of any other sub-frame of the N sub-frames in which the sub-pixel 2 is not to be driven to emit light, the sub-pixel 2 is controlled to emit light in the sub-frames each having a shorter duration. While displaying at a low grayscale, a display precision of the sub-pixel 2 can be further improved by using the light-emitting sub-frames having a shorter light-emitting duration, thereby further improving the display precision at the low grayscale.

Figure 10:
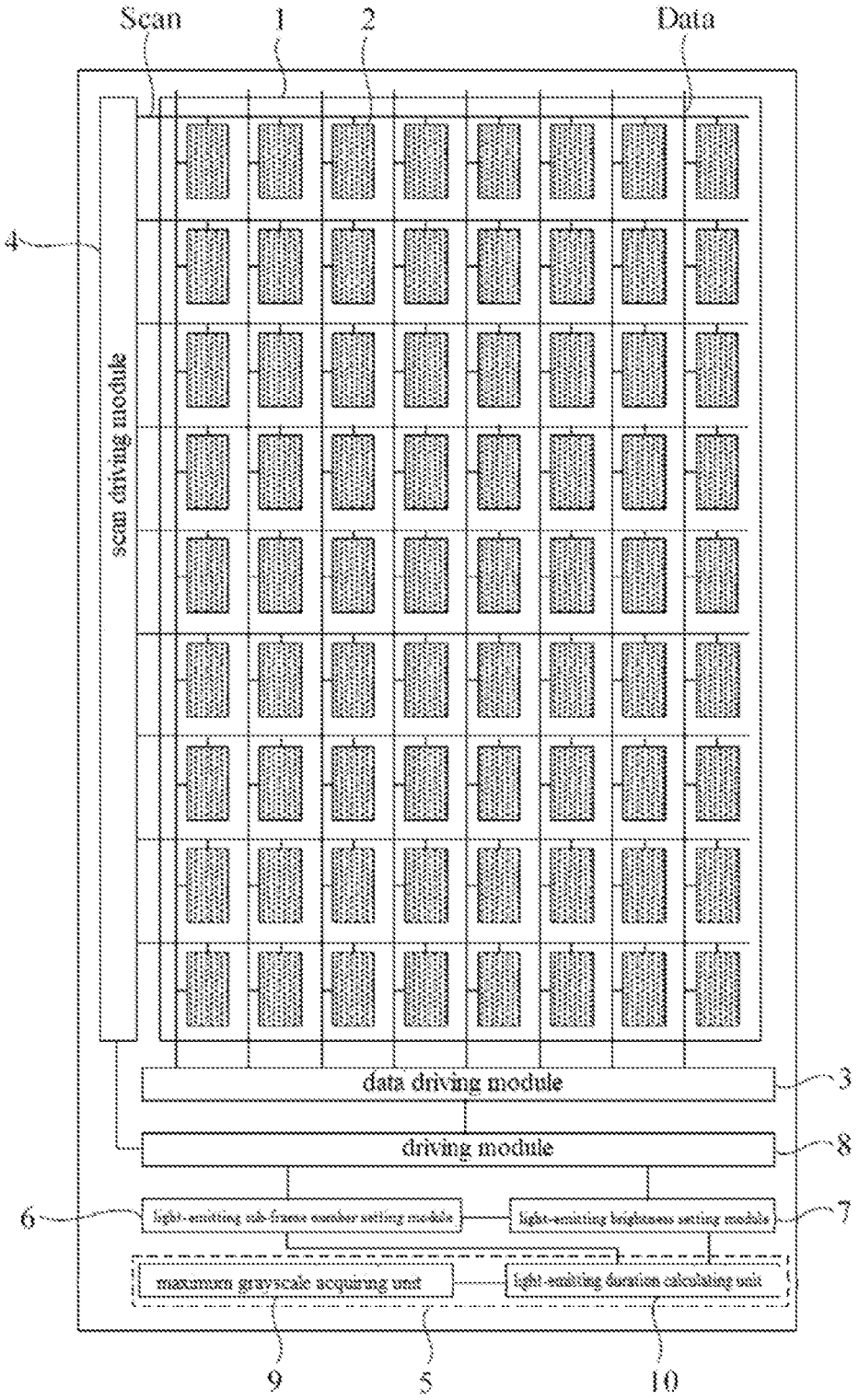
FIG. 10 is another structural schematic diagram of a display device according to an embodiment of the present disclosure.

FIG. 10 is another structural schematic diagram of a display device according to an embodiment of the present disclosure. In this embodiment, as shown in FIG. 10, the light-emitting duration setting module 5 includes a maximum grayscale acquiring unit 9 and a light-emitting duration calculating unit 10. The maximum grayscale acquiring unit 9 is configured to acquire a maximum grayscale value $G_M$ displayed by the display panel. The light-emitting duration calculating unit 10 is electrically connected to the maximum grayscale acquiring unit 9, the light-emitting sub-frame number setting module 6, and the light-emitting brightness setting module 7, and is configured to calculate the light-emitting duration $T_i$ of an $i^{th}$ sub-frame of the N sub-frames according to $$T_i \propto \gamma\left(\frac{i}{N} \times G_M\right),$$

where γ is a mapping relationship between a grayscale value and a display brightness value.

When the display panel displays images in a one-frame period, there may be some sub-pixels 2 that need to display with a display brightness value corresponding to the maximum grayscale value $G_M$. Therefore, by calculating the light-emitting duration of each sub-frame according to the maximum grayscale value $G_M$, it can be ensured that the sub-pixel 2 can achieve a display brightness corresponding to the maximum grayscale value when the sub-pixel 2 emits light in the sub-frame, which improves the display precision of the sub-pixel 2.

Figure 11:
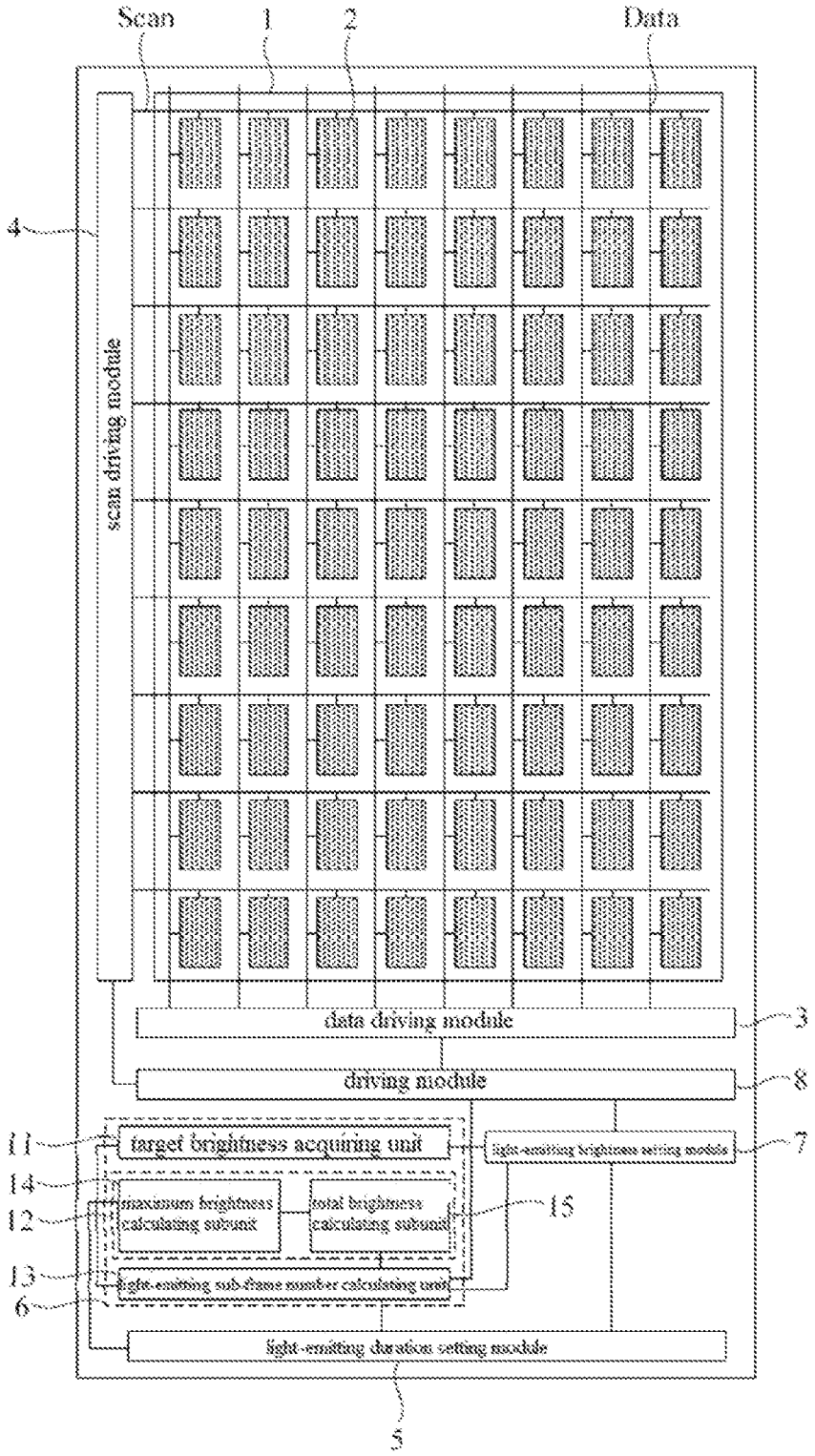
FIG. 11 is yet another structural schematic diagram of a display device according to an embodiment of the present disclosure.

FIG. 11 is another structural schematic diagram of a display device according to an embodiment of the present disclosure. In this embodiment, as shown in FIG. 11, the light-emitting sub-frame number setting module 6 includes a target brightness acquiring unit 11, a total brightness acquiring unit 12 and a light-emitting sub-frame number calculating unit 13. The target brightness acquiring unit 11 is configured to acquire a target grayscale value G to be displayed by the sub-pixel 2 in the one-frame period, and to acquire, according to $L \propto \gamma(G)$, the target display brightness value L corresponding to the target grayscale value G, where γ is a mapping relationship between a grayscale value and a display brightness value. The total brightness acquiring unit 12 is electrically connected to the light-emitting duration setting module 5, and is configured to acquire, according to a maximum light-emitting brightness value $L_M$ f the sub-pixel 2, a maximum total display brightness $S_i$ of the sub-pixel 2 in first i sub-frames of the N sub-frames. The light-emitting sub-frame number calculating unit 13 is electrically connected to the target brightness acquiring unit 11, the total brightness acquiring unit 12, the light-emitting duration setting module 5, the light-emitting brightness setting module 7, and the driving module 8, respectively, and is configured to acquire, according to $S_{k-1} < L \leq S_k$, the number k of sub-frames in the one-frame period in which the sub-pixel 2 is to be driven to emit light. The light-emitting sub-frame number calculating unit 13 compares the target display brightness value L and the maximum total display brightness $S_{k-1}$ and $S_k$ to obtain k, and k that is as small as possible can be acquired on a premise that it is ensured that the sub-pixel 2 can achieve the target display brightness value L in the one-frame period, that is, to cause the sub-pixel 2 to emit light in the sub-frames having a shorter light-emitting duration, thereby further improving the display precision when displaying at a low grayscale.

In an embodiment, referring again to FIG. 11, the total brightness acquiring unit 12 includes a maximum brightness calculating subunit 14 and a total brightness calculating subunit 15. The maximum brightness calculating subunit 14 is electrically connected to the light-emitting duration setting module 5, and is configured to calculate a maximum display brightness $L_{i_MAX}$ of an $i^{th}$ sub-frame of the N sub-frames according to $$L_{i_MAX} = \frac{L_M \times T_i}{T_f}.$$

The total brightness calculating subunit 15 is electrically connected to both the maximum brightness calculating subunit 14 and the light-emitting sub-frame number calculating unit 13, and is configured to calculate the maximum total display brightness $S_i$ of the sub-pixel 2 in first i sub-frames of the N sub-frames according to $$S_i = \sum_{j=1}^{i} L_{j_MAX}.$$

Since different sub-frames have different durations, firstly, the maximum brightness calculation subunit 14 calculates a maximum display brightness of each sub-frame according to the maximum light-emitting brightness value $L_M$ of the sub-pixel 2 and a light-emitting duration of each sub-frame, and then according to the maximum display brightness corresponding to each sub-frame in the first i sub-frames, the total brightness calculating subunit 15 calculates the maximum total display brightness $S_i$ of the first i sub-frames, thereby accurately acquiring the k.

In an embodiment, referring again to FIG. 11, the light-emitting brightness setting module 7 is further electrically connected to both the light-emitting duration setting module 5 and the target brightness acquiring unit 11, and is configured to calculate the light-emitting brightness value $L_{emic}$ according to $$L_{emit} = \frac{L \times T_f}{T_1 + T_2 + \ldots + T_k},$$

where $T_f$ is a duration of the one-frame period.

After the light-emitting sub-frame number calculating unit 13 determines the number k of sub-frames in which the sub-pixel is to be driven, when the sub-pixel 2 emits light with the light-emitting brightness value Le t, the total display brightness in the k sub-frames should be a target display brightness corresponding to the sub-pixel 2, i.e., $$L = \frac{\sum_{i=1}^{k} L_{emit} T_i}{T_f},$$

and then it is deduced:

$$L_{emit} = \frac{L \times T_f}{T_1 + T_2 + \ldots + T_k}.$$

It can be seen that, the light-emitting brightness value $L_{emit}$ is acquired according to the formula, and when controlling the sub-pixel 2 to emit light with the light-emitting brightness value $L_{emit}$ in the k sub-frames, it can be ensured that the display brightness of the sub-pixel 2 in the one-frame period is the target display brightness, thereby ensuring the display precision.

Figure 12:
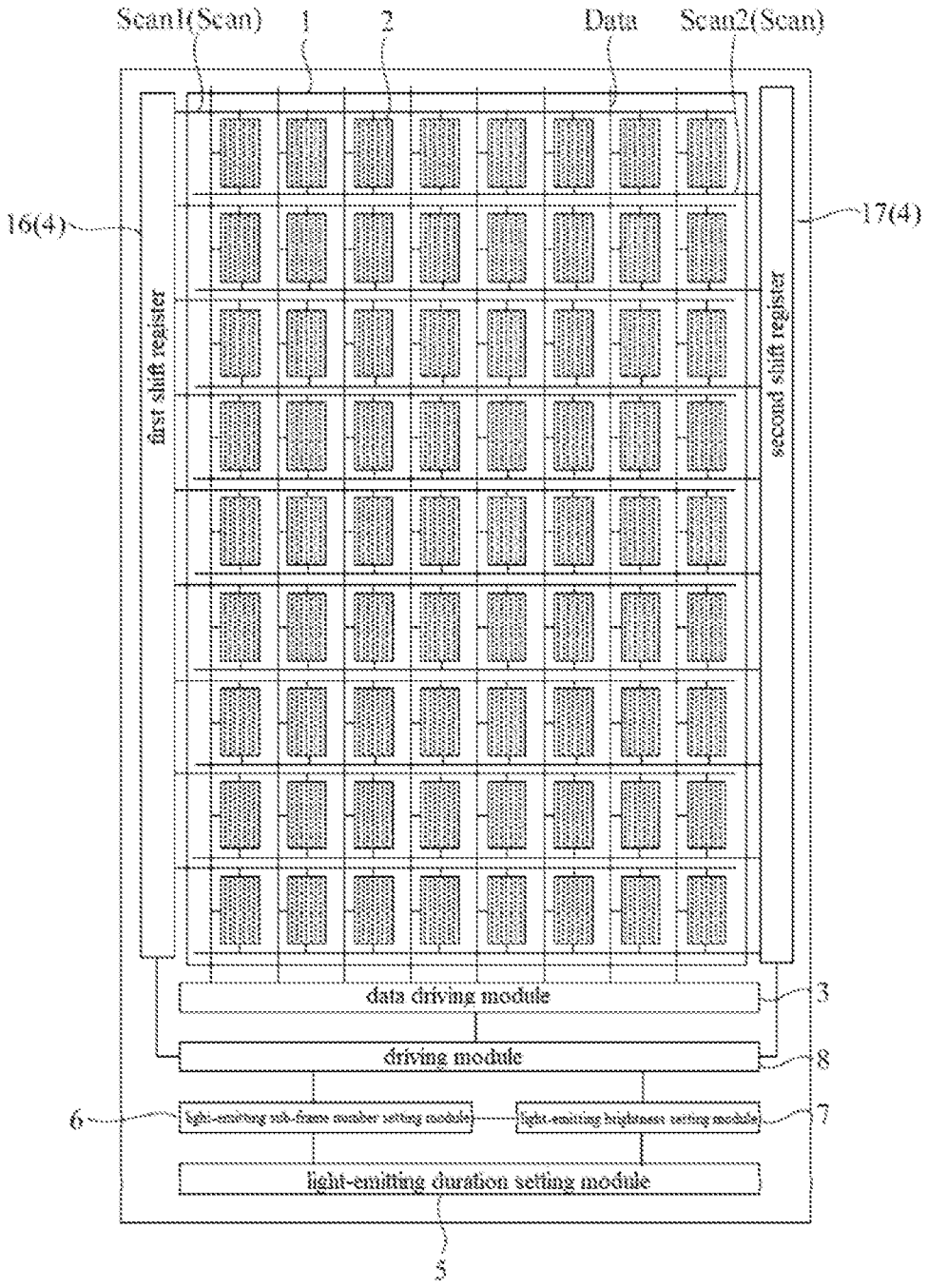
FIG. 12 is still yet another structural schematic diagram of a display device according to an embodiment of the present disclosure.

FIG. 12 is a still another structural schematic diagram of a display device according to an embodiment of the present disclosure. In this embodiment, as shown in FIG. 12, the scan driving module 4 includes a first shift register 16 and a second shift register 17. The plurality of scanning lines Scan includes first scanning lines Scan1 and second scanning lines Scan2. The first shift register is electrically connected to the first scanning lines Scan1 and the driving module 8. The first shift register 16 is configured to be driven by the driving module 8 to provide a first scanning signal Scan1 to the first scanning lines and reset a gate voltage of a driving transistor of the sub-pixel in a first sub-frame, and to not provide the first scanning signal to the first scanning lines Scan1 and not reset the gate voltage of the driving transistor in the sub-pixel in second to $k^{th}$ sub-frames. The second shift register 17 is electrically connected to the second scanning lines Scan2 and the driving module 8, and is configured to be driven by the driving module 8 in first to $k^{th}$ sub-frames to provide a second scanning signal to the second scanning lines Scan2 and control a data voltage signal to be written into the drive transistor.

Combining the above-mentioned working principle of the pixel circuit, in related art, the first scanning signal and the second scanning signal are provided by using only one shift register, and the first scanning signal and the second scanning signal are reused, that is, the first scanning signal of a current stage is reused as the second scanning signal of a previous stage. In the embodiment of the present disclosure, for one sub-pixel 2, in the first sub-frame, the gate voltage of the driving transistor needs to be reset using the first scanning signal, and in the second to $k^{th}$ sub-frames, the gate voltage of the driving transistor does not need to be reset using the first scanning signal. That is, the first scanning signal of the low level needs to be provided in the initialization period of the first sub-frame, and the first scanning signal of the low level does not need to be provided in the initialization period of the second to $k^{th}$ sub-frames. Therefore, the first scanning signal and the second scanning signal are not reused in the second to $k^{th}$ sub-frames. At this time, by providing the first shift register 16 and the second shift register 17, the first scanning signal and the second scanning signal are provided by the first shift register 16 and the second shift register 17, respectively, thereby ensuring output accuracy of the first scanning signal and the second scanning signal and in turn ensuring that the gate voltage of the driving transistor is not reset in the second to $k^{th}$ sub-frames. Therefore, it is not necessary to rewrite the data voltage signal, thereby reducing the complexity of the driving method, simplifying the driving process, and saving the writing time of the data voltage signal in the second to $k^{th}$ sub-frames.

Further, when k<N, in $(k+1)^{th}$ to $N^{th}$ sub-frames, the first shift register 16 is driven by the driving module 8 to not provide the first scanning signal to the first scanning lines Scan1, the second shift register 17 is driven by the driving module 8 to provide the second scanning signal to the second scanning lines Scan2, and the data driving module 3 is driven by the driving module 8 to provide a black state data voltage to the data lines Data.

In the $(k+1)^{th}$ to $N^{th}$ sub-frames, by writing the black data voltage signal $V_{Data2}$ to the driving transistor, the sub-pixel 2 can be prevented from emitting light, thereby avoiding affecting an actual display brightness value of the sub-pixel 2 in the one-frame period and avoiding deviation from the target brightness value. Since it is only required that the sub-pixel 2 present a black state in the $(k+1)^{th}$ to $N^{th}$ sub-frames, in order to further simplify the driving method and save the writing time of the data voltage signal, the gate voltage of the driving transistor is not reset, and the black state data voltage signal $V_{Data2}$ is directly written into the driving transistor.

The above are merely some embodiments of the present disclosure, but not intended to limit the present disclosure. Any modifications, equivalent alternatives or improvements made by those skilled in the art without departing from the scope of the present disclosure are to be encompassed by the scope of the present disclosure.

What is claimed is:

1. A method for driving a display panel, comprising:

dividing a one-frame period of the display panel into N sub-frames, and setting a light-emitting duration $T_i$ of an $i^{th}$ sub-frame of the N sub-frames, wherein N is a positive integer greater than 1, and wherein i=1 to N;

determining, based on a target display brightness value L, a number k of sub-frames of the N sub-frames in which a sub-pixel is to be driven to emit light, wherein when k<N, a light-emitting duration of any one of the k sub-frames is shorter than a light-emitting duration of any other one of the N sub-frames in which the sub-pixel is not to be driven to emit light;

acquiring a light-emitting brightness value $L_{emit}$ of the sub-pixel in each of the k sub-frames based on the target display brightness value L; and driving the sub-pixel to emit light with the light-emitting brightness value $L_{emit}$ in each of the k sub-frames.

2. The method according to claim 1, wherein when setting the light-emitting duration of each of the N sub-frames, it is set that $T_m > T_{m-1}$, wherein $T_m$ is a light-emitting duration of an $m^{th}$ sub-frame of the N sub-frames, and $T_{m-1}$ is a light-emitting duration of a $(m-1)^{th}$ sub-frame of the N sub-frames, where m=2 to N.

3. The method according to claim 2, wherein said setting the light-emitting duration of each of the N sub-frames comprises:

acquiring a maximum grayscale value $G_M$ that the display panel can display; and calculating, based on $$T_i \propto \gamma\left(\frac{i}{N} \times G_M\right),$$

the light-emitting duration $T_i$ of the $i^{th}$ sub-frame of the N sub-frames, where γ is a mapping relationship between a grayscale value and a display brightness value.

4. The method according to claim 1, wherein said determining, based on the target display brightness value L, the number k of sub-frames of the N sub-frames in which the sub-pixel is to be driven to emit light comprises:

acquiring a target grayscale value G to be displayed by the sub-pixel in the one-frame period, and acquiring, based on $L \propto \gamma(G)$, the target display brightness value L corresponding to the target grayscale value G, where γ is a mapping relationship between a grayscale value and a display brightness value;

acquiring, based on a maximum light-emitting brightness value $L_M$ of the sub-pixel, a maximum total display brightness $S_i$ of the sub-pixel in first i sub-frames of the N sub-frames; and acquiring, based on $S_{k-1} < L \leq S_k$, the number k of sub-frames in the one-frame period in which the sub-pixel is to be driven to emit light.

5. The method according to claim 4, wherein said acquiring, based on the maximum light-emitting brightness value $L_M$ of the sub-pixel, the maximum total display brightness $S_i$ of the sub-pixel in the first i sub-frames of the N sub-frames comprises:

calculating, based on $$L_{i_MAX} = \frac{L_M \times T_i}{T_f},$$

a maximum display brightness $L_{i_MAX}$ of an $i^{th}$ sub-frame of the N sub-frames; and calculating, based on $$S_i = \sum_{j=1}^{i} L_{j_MAX},$$

the maximum total display brightness $S_i$ of the sub-pixel in the first i sub-frames of the N sub-frames.

6. The method according to claim 4, wherein said acquiring the light-emitting brightness value $L_{emit}$ of the sub-pixel in each of the k sub-frames based on the target display brightness value L comprises:

acquiring the light-emitting brightness value $L_{emit}$ based on $$L_{emit} = \frac{L \times T_f}{T_1 + T_2 + \ldots + T_k},$$

where $T_f$ is a duration of the one-frame period.

7. The method according to claim 1, wherein said driving the sub-pixel to emit light with the light-emitting brightness value Luau in each of the k sub-frames comprises:

in a first sub-frame, resetting a gate voltage of a driving transistor of the sub-pixel and writing a light-emitting data voltage signal $V_{Data1}$ corresponding to the light-emitting brightness value $L_{emit}$ into the driving transistor; and in second to $k^{th}$ sub-frames, continuously writing the light-emitting data voltage signal $V_{Data1}$ into the driving transistor without resetting the gate voltage of the driving transistor.

8. The method according to claim 7, wherein, when k<N, the driving method further comprises:

in $(k+1)^{th}$ to $N^{th}$ sub-frames, writing a black state data voltage signal $V_{Data2}$ into the driving transistor without resetting the gate voltage of the driving transistor.

9. A display device, comprising:

a display panel comprising a plurality of scanning lines, a plurality of data lines, and a plurality of sub-pixels, wherein the plurality of scanning lines intersect with the plurality of data lines;

a data driving module configured to provide a data voltage to the plurality of data lines;

a scan driving module configured to sequentially provide a scanning signal to the plurality of scanning lines;

a light-emitting duration setting module configured to divide a one-frame period of the display panel into N sub-frames and to set a light-emitting duration $T_i$ of an $i^{th}$ sub-frame of the N sub-frames, wherein N is a positive integer greater than 1, and wherein i=1 to N;

a light-emitting sub-frame number setting module electrically connected to the light-emitting duration setting module, and configured to determine, based on a target display brightness value L, a number k of sub-frames of the N sub-frames in which a sub-pixel of the plurality of sub-pixels is to be driven to emit light, wherein when k<N, a light-emitting duration of any one of the k sub-frames is shorter than a light-emitting duration of any other one of the N sub-frames in which the sub-pixel is not to be driven to emit light;

a light-emitting brightness setting module electrically connected to both the light-emitting duration setting module and the light-emitting sub-frame number setting module and configured to acquire a light-emitting brightness value $L_{emit}$ of the sub-pixel in each of the k sub-frames based on the target display brightness value L; and a driving module electrically connected to the data driving module, the scan driving module, the light-emitting sub-frame number setting module and the light-emitting brightness setting module, and configured to drive the data driving module to provide the plurality of data lines with a light-emitting data voltage signal corresponding to the light-emitting brightness value $L_{emit}$, and configured to drive the scan driving module to provide the scanning signal to the plurality of scanning lines in each of the k sub-frames, so as to control the sub-pixel to emit light.

10. The display device according to claim 9, wherein the light-emitting duration setting module comprises:

a maximum grayscale acquiring unit configured to acquire a maximum grayscale value $G_M$ that the display panel can display; and a light-emitting duration calculating unit that is electrically connected to the maximum grayscale acquiring unit, the light-emitting sub-frame number setting module, and the light-emitting brightness setting module, and configured to calculate, based on $$T_i \propto \gamma\left(\frac{i}{N} \times G_M\right),$$

the light-emitting duration $T_i$ of the $i^{th}$ sub-frame of the N sub-frames, where γ is a mapping relationship between a grayscale value and a display brightness value.

11. The display device according to claim 9, wherein the light-emitting sub-frame number setting module comprises:

a target brightness acquiring unit configured to acquire a target grayscale value G to be displayed by the sub-pixel in the one-frame period and to acquire, based on $L \propto \gamma(G)$, the target display brightness value L corresponding to the target grayscale value G, where γ is a mapping relationship between a grayscale value and a display brightness value;

a total brightness acquiring unit electrically connected to the light-emitting duration setting module and configured to acquire, based on a maximum light-emitting brightness value $L_M$ of the sub-pixel, a maximum total display brightness $S_i$ of the sub-pixel in first i sub-frames of the N sub-frames; and a light-emitting sub-frame number calculating unit electrically connected to the target brightness acquiring unit, the total brightness acquiring unit, the light-emitting duration setting module, the light-emitting brightness setting module, and the driving module, and configured to acquire, based on $S_{k-1} < L\ S_k$, the number k of sub-frames in the one-frame period in which the sub-pixel is to be driven to emit light.

12. The display device according to claim 11, wherein the total brightness acquiring unit comprises:

a maximum brightness calculating subunit electrically connected to the light-emitting duration setting module and configured to calculate, based on $$L_{i_MAX} = \frac{L_M \times T_i}{T_f},$$

a maximum display brightness $L_{i_MAX}$ of an $i^{th}$ sub-frame of the N sub-frames; and a total brightness calculating subunit electrically connected to the maximum brightness calculating subunit and the light-emitting sub-frame number calculating unit, and configured to calculate, based on $$S_i = \sum_{j=1}^{i} L_{j_MAX},$$

the maximum total display brightness $S_i$ of the sub-pixel in the first i sub-frames of the N sub-frames.

13. The display device according to claim 11, wherein the light-emitting brightness setting module is further electrically connected to the light-emitting duration setting module and the target brightness acquiring unit, and is configured to calculate the light-emitting brightness value $L_{emit}$ based on $$L_{emit} = \frac{L \times T_f}{T_1 + T_2 + \ldots + T_k},$$

where $T_f$ is a duration of the one-frame period.

14. The display device according to claim 9, wherein the scan driving module comprises a first shift register and a second shift register, and the plurality of scanning lines comprises first scanning lines and second scanning lines;

wherein the first shift register is electrically connected to the first scanning lines and the driving module, and is configured to be driven by the driving module to provide a first scanning signal to the first scanning lines and reset a gate voltage of a driving transistor of the sub-pixel in a first sub-frame, and is configured to not provide the first scanning signal to the first scanning lines and to not reset the gate voltage of the driving transistor of the sub-pixel in second to $k^{th}$ sub-frames; and wherein the second shift register is electrically connected to the second scanning lines and the driving module, and is configured to be driven by the driving module in first to $k^{th}$ sub-frames to provide a second scanning signal to the second scanning lines and control a data voltage signal to be written into the drive transistor.

15. The display device according to claim 14, wherein when k<N, in $(k+1)^{th}$ to $N^{th}$ sub-frames, the first shift register is driven by the driving module to not provide the first scanning signal to the first scanning lines, the second shift register is driven by the driving module to provide the second scanning signal to the second scanning lines, and the data driving module is driven by the driving module to provide a black state data voltage to the plurality of data lines.

* * * * *